US005584159A

United States Patent [19]

Presley

[11] Patent Number: 5,584,159

[45] Date of Patent: Dec. 17, 1996

[54] MASONRY ARCH SUPPORT APPARATUS AND METHOD

[76] Inventor: James R. Presley, Rte. 3, Box 2578 A, Magnolia, Tex. 77355

[21] Appl. No.: 377,830

[22] Filed: Jan. 25, 1995

[51] Int. Cl.[6] ..... E04D 15/00

[52] U.S. Cl. ..... 52/749.14; 52/749.15; 52/747.12; 52/745.08

[58] Field of Search ..... 52/749.14, 749.15, 52/747.12, 745.08, 85

[56] References Cited

U.S. PATENT DOCUMENTS

| | | | |
|---|---|---|---|
| 3,298,155 | 1/1967 | Byfield et al. | 52/749.15 |
| 4,584,812 | 4/1986 | Miskolczi, Jr. | 52/749.15 |
| 5,101,608 | 4/1992 | Ewers | 52/749.15 |

*Primary Examiner*—Carl D. Friedman
*Assistant Examiner*—W. Glenn Edwards
*Attorney, Agent, or Firm*—Kenneth A. Roddy

[57] ABSTRACT

A first hub is positioned at the center of a curved surface to be lined with bricks. A second hub is positioned adjacent the first and has an outer wall extending beyond the width of the first hub in radially spaced relation with a series of circumferentially spaced slots therein. Mortared bricks are placed sequentially against the curved surface and supported by telescopic spring-loaded brick support struts placed on the second hub to extend generally radially outward therefrom and engage each mortared brick to form a ring of bricks each pressed against the curved surface by a brick support strut. Telescopic spring-loaded rib support struts are sequentially placed on the first hub to extend radially outward through the slots of the second hub and engage the approximate center of certain circumferentially spaced bricks of the ring of bricks. Each rib support strut is sequentially contracted and an elongate resilient rib is installed between the outer end of the rib support struts and the inner diameter of the ring of bricks such that the rib member and rib support struts exert a radial outward force thereon. A coupling is connected to the rib support struts and a second ring of bricks are installed adjacent the first ring and supported by brick support struts while a second rib is installed in the couplings. Subsequent rings of bricks are installed by removing the brick support struts, installing another first hub and repositioning the second hub adjacent thereto and repeating the process.

22 Claims, 9 Drawing Sheets

MASONRY ARCH SUPPORT APPARATUS AND METHOD

BACKGROUND OF THE INVENTION

1. Field of the Invention

This invention relates generally to supports and templates for masonry construction, and more particularly to an arch support system for masonry construction to support brickwork against a curved surface as the bricks are laid.

2. Brief Description of the Prior Art

It is very difficult and time consuming to install brickwork to concave arcuate, domed, or curved surfaces such as the interior of tunnels, vessels and kilns, etc., particularly when the bricks must be laid and supported in an arcuate overhead position and in adjacent rows or rings extending for great distances.

Dominquez, U.S. Pat. No. 4,702,044 discloses an adjustable arch support for the laying of brickwork which incorporates a central hub having a plurality of radially extending telescopic struts pivotally connected at their inner ends to the central hub and pivotally connected at their outer ends to a flexible band. The band incorporates at least one lockable hinge allowing the band to be set either to an even curve or to a discontinuous curve having a peak at the hinge. The shape of the arch is determined by adjustment of the struts which bends the band to the desired configuration.

The present invention is distinguished over the prior art in general, and this patent in particular by an apparatus and method for supporting brickwork against a curved surface during masonry construction wherein a first hub is positioned at the center of a curved surface to be lined with bricks. A second hub is positioned adjacent the first and has an outer wall extending beyond the width of the first hub in radially spaced relation with a series of circumferentially spaced slots therein. Mortared bricks are placed sequentially against the curved surface and supported by telescopic spring-loaded brick support struts placed on the second hub to extend generally radially outward therefrom and engage each mortared brick to form a ring of bricks each pressed against the curved surface by a brick support strut. Telescopic spring-loaded rib support struts are sequentially placed on the first hub to extend radially outward through the slots of the second hub and engage the approximate center of certain circumferentially spaced bricks of the ring of bricks. Each rib support strut is sequentially contracted and an elongate resilient rib is installed between the outer end of the rib support struts and the inner diameter of the ring of bricks such that the rib member and rib support struts exert a radial outward force thereon. A coupling is connected to the rib support struts and a second ring of bricks are installed adjacent the first ring and supported by brick support struts while a second rib is installed in the couplings. Subsequent rings of bricks are installed by removing the brick support struts, installing another first hub and repositioning the second hub adjacent thereto and repeating the process.

SUMMARY OF THE INVENTION

It is therefore an object of the present invention to provide an arch support system for masonry construction to support bricks against a curved surface as the bricks are being laid.

It is another object of this invention to provide an arch support system for masonry construction which allows brickwork to be easily and quickly installed on concave arcuate, domed, or curved surfaces such as the interior of tunnels, vessels, and kilns.

Another object of this invention is to provide an arch support system for masonry construction which allows brickwork to be easily and quickly installed and supported in an arcuate overhead position and in adjacent rows or rings extending for great distances.

Another object of this invention is to provide an arch support system for masonry construction in portable modular form which is easily and quickly erected and taken down.

Another object of this invention is to provide an arch support system for masonry construction in modular form which is easily and quickly adjusted to fit a variety of sizes of curved surfaces.

A further object of this invention is to provide an arch support system for masonry construction wherein the components are quickly erected and reused sequentially to allow continuous installation of brickwork with no down-time while the mortar sets.

A still further object of this invention is to provide an arch support system for masonry construction which is simple in construction, and economical to manufacture.

Other objects of the invention will become apparent from time to time throughout the specification and claims as hereinafter related.

The above noted objects and other objects of the invention are accomplished by an apparatus and method for supporting brickwork against a curved surface during masonry construction wherein a first hub is positioned at the center of a curved surface to be lined with bricks. A second hub is positioned adjacent the first and has an outer wall extending beyond the width of the first hub in radially spaced relation with a series of circumferentially spaced slots therein. Mortared bricks are placed sequentially against the curved surface and supported by telescopic spring-loaded brick support struts placed on the second hub to extend generally radially outward therefrom and engage each mortared brick to form a ring of bricks each pressed against the curved surface by a brick support strut. Telescopic spring-loaded rib support struts are sequentially placed on the first hub to extend radially outward through the slots of the second hub and engage the approximate center of certain circumferentially spaced bricks of the ring of bricks. Each rib support strut is sequentially contracted and an elongate resilient rib is installed between the outer end of the rib support struts and the inner diameter of the ring of bricks such that the rib member and rib support struts exert a radial outward force thereon. A coupling is connected to the rib support struts and a second ring of bricks are installed adjacent the first ring and supported by brick support struts while a second rib is installed in the couplings. Subsequent rings of bricks are installed by removing the brick support struts, installing another first hub and repositioning the second hub adjacent thereto and repeating the process.

DESCRIPTION OF THE PREFERRED EMBODIMENT

Figure 1:
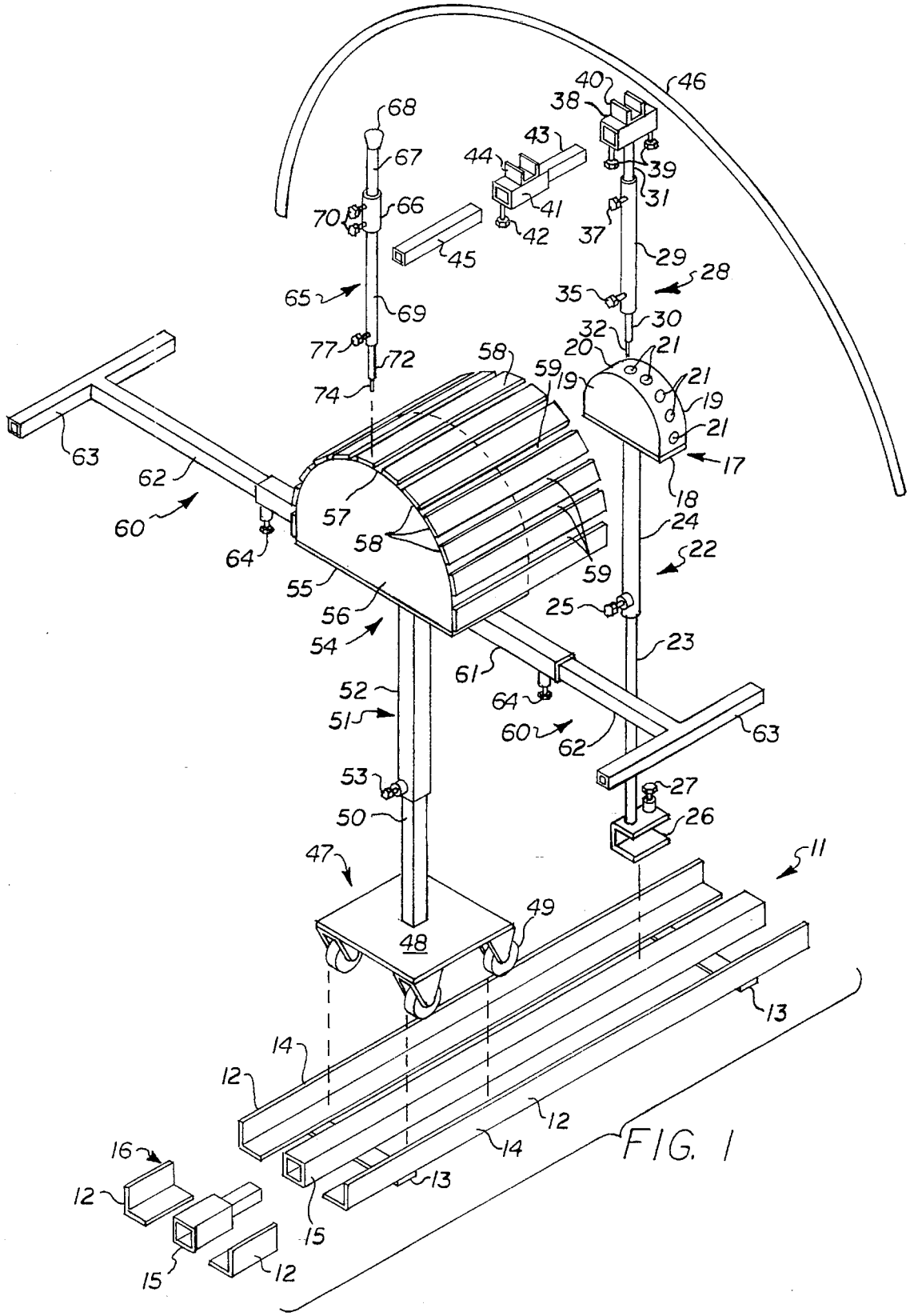
FIG. 1 is an exploded isometric view of the major components of the arch support apparatus for masonry construction in accordance with the present invention.

Referring to the drawings by numerals of reference, there is shown in FIG. 1, an exploded isometric view of the major components of a preferred arch support system 10 for masonry construction to support brickwork against a curved surface as the bricks are laid.

A base track assembly 11 having a pair of opposed L-shaped angle members 12 secured in parallel laterally spaced relation by transverse crossmembers 13 forms a pair of guide rails 14. A length of square tubing 15 secured to the crossmembers 13 extends longitudinally between the guide rails 14 along a center longitudinal axis. Similar track assembly extension members 16 formed of square tubing 15 and angle members 12 may be joined to either end of the base track assembly 11 to extend it in the longitudinal direction.

A semicircular rib support hub 17 is secured to the top end of a tubular telescopic vertical support leg 22. The rib support hub 17 has a flat bottom 18, opposed ends 19, and an arcuate curved top wall 20. A series of circumferentially spaced holes 21 extend a short distance inwardly from the arcuate top wall 20 of the rib support hub 17. The circumferential spacing of the holes 21 in the arcuate top wall of the rib support hub 17 correspond in direct relation to predetermined chord points (for example 14" or 16") on a semicircular ring of bricks to be installed on a concentrically spaced curved surface (described hereinafter).

The tubular telescopic vertical support leg 22 is formed of a lower tubular member 23 slidably received in the bottom end of an upper tubular member 24. The rib support hub 17 is secured to the top end of the upper tubular member 24. A lock screw 25 installed through the side wall of the upper tubular member 24 near its bottom end grips the lower tubular member 23 to adjust the vertical length of the support leg 22. A square C-shaped clamp 26 having a lock screw 27 is secured to the bottom end of the lower tubular member 23. The clamp 26 removably clamps the vertical support leg 22 to the central length of square tubing 15 of the base track assembly 11. Several rib support hub assemblies are provided, depending upon the particular job requirements.

Figure 2:
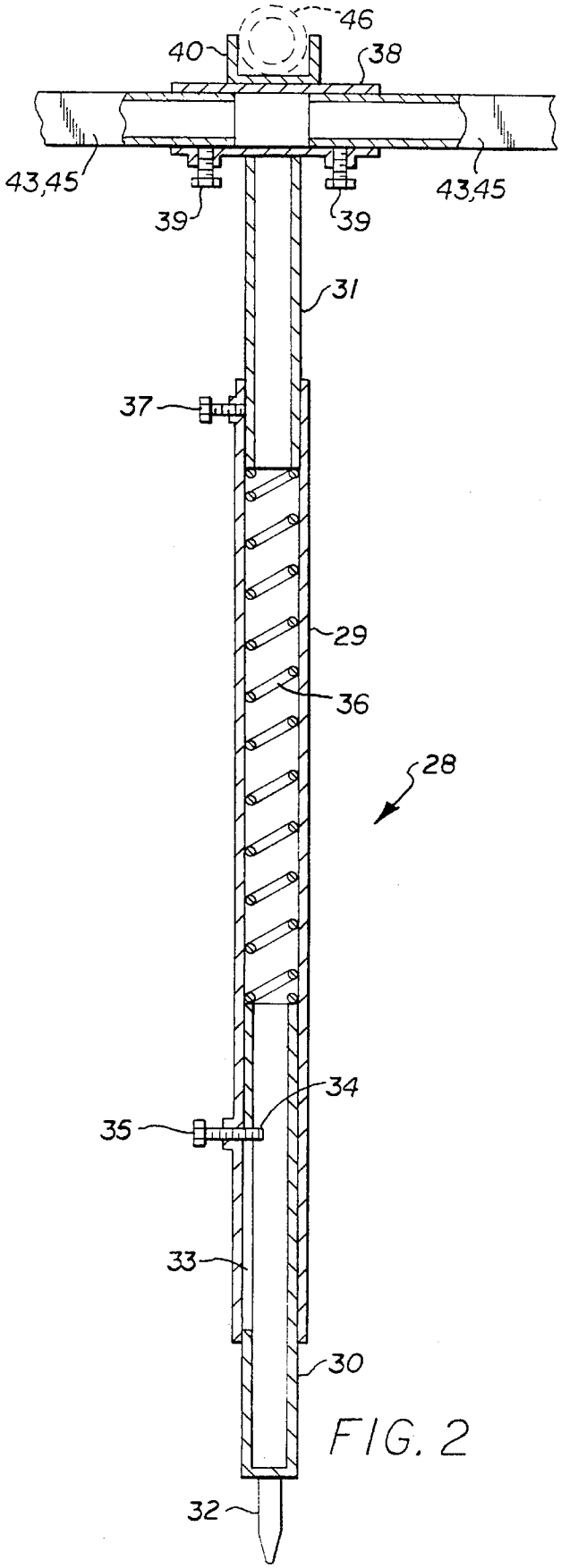
FIG. 2 is a longitudinal cross section through a rib support strut component of the arch support apparatus.

A series of tubular telescopic spring-loaded longitudinally adjustable rib support struts 28 are used with the rib support hub 17. Referring additionally to FIG. 2, each rib support strut 28 has an intermediate tubular member 29 with a lower tubular member 30 slidably received in its bottom end and an upper tubular member 31 slidably received in its top end. The lower tubular member 30 is enclosed at its bottom end and a short pin 32 extends from the enclosed bottom end. A longitudinal slot 33 extends through the side wall of the lower tubular member 30 intermediate its top and bottom ends. The shank 34 of a lock screw 35 installed through the side wall of the intermediate tubular member 29 near its bottom end is received in the slot 33 to prevent complete removal of the lower tubular member 30, while allowing axial travel relative to the intermediate tubular member 29. A compression spring 36 is installed inside the intermediate tubular member 29 and engaged with the top and bottom ends, respectively, of the lower and upper tubular members 30 and 31. A lock screw 37 is installed through the side wall of the intermediate tubular member 29 near its top end to grip the upper tubular member 31. The pins 32 at the bottom end of the rib support struts 28 are received in the holes 21 in the arcuate top wall 20 of the rib support hub 17, and the rib support struts extend radially outward from the rib support hub.

A short length of square tubing 38 is secured to the outer end of each upper tubular member 31. A pair of lock screws 39 extend through the bottom wall of the short length of square tubing 38 near each outer end. A U-shaped channel element 40 is secured to the top wall of each short length of square tubing 38.

Referring again to FIG. 1, a series of square tubing coupling members 41 are provided which have a lock screw 42 that extends through their bottom wall at one end, a tubular extension 43 extending from the opposite end, and a U-shaped channel element 44 secured to their top wall. The tubular extension 43 is received in the open end of the short length of square tubing 38 at the outer ends of each rib support strut 28 and extends perpendicular to the rib support strut. A series of square tubing spacer extensions 45 are also provided. The ends of the spacer extensions 45 are sized to fit inside the coupling members 41 and short length of square 38 at the outer ends of the rib support struts 28.

A series of elongate tubular rib members 46 formed of resilient material, such as PVC tubing are provided. The rib members 46 are received and supported in the channel elements 40 and 44 on the short length of square tubing 38 of the rib support struts 28 and coupling members 41, respectively, as described hereinafter.

A carriage 47 having a flat top plate 48 with four wheels 49 near each corner rides in the L-shaped angle members 12 of the track assembly 11. The lower tubular member 50 of a tubular telescopic vertical support leg 51 is secured at its bottom end to the center of the top plate 48 of the carriage 47 and its top end is slidably received in the bottom end of an upper tubular member 52. A lock screw 53 installed through the side wall of the upper tubular member 52 near its bottom end grips the lower tubular member 50 to adjust the vertical length of the support leg 51.

A semicircular brick support hub 54 is secured to the top end of the upper tubular member 52 of the vertical support leg 51. The brick support hub 54 has a flat bottom wall 55, opposed end walls 56, and an arcuate curved top wall 57. A series of spaced apart flat members 58 are secured to the top wall 57 of the hub 54 and extend outwardly beyond one end wall to define circumferentially spaced transverse openings or slots 59 therebetween. The length of the flat members 58 are approximately the same length as two bricks placed end to end with a mortar joint therebetween. The circumferential spacing of the slots 59 in the arcuate top wall of the brick support hub 54 correspond to the spacing of the holes 21 in the rib support hub 17. In other words, the centers of the slots 59 correspond to predetermined chord points (for example 14" or 16") on a semicircular ring of bricks to be installed on the concentrically spaced curved surface (described hereinafter). The width of each slot 59 is sufficient to allow the rib support struts 28 to extend radially therethrough between adjacent flat members 58.

Telescoping lateral span arms 60 extend laterally outward from the bottom of the brick support hub 54 on opposite sides. The lateral span arms 60 are formed of a center member 61 of square tubing with one end of inner members 62 of square tubing slidably received in the opposite ends of the center member. A square tubing member 63 is secured at its center to the outer end of each inner tubular member 62 perpendicular thereto. A pair of lock screws 64 extend through the side wall of the center member 61 near each outer end.

Figure 3:
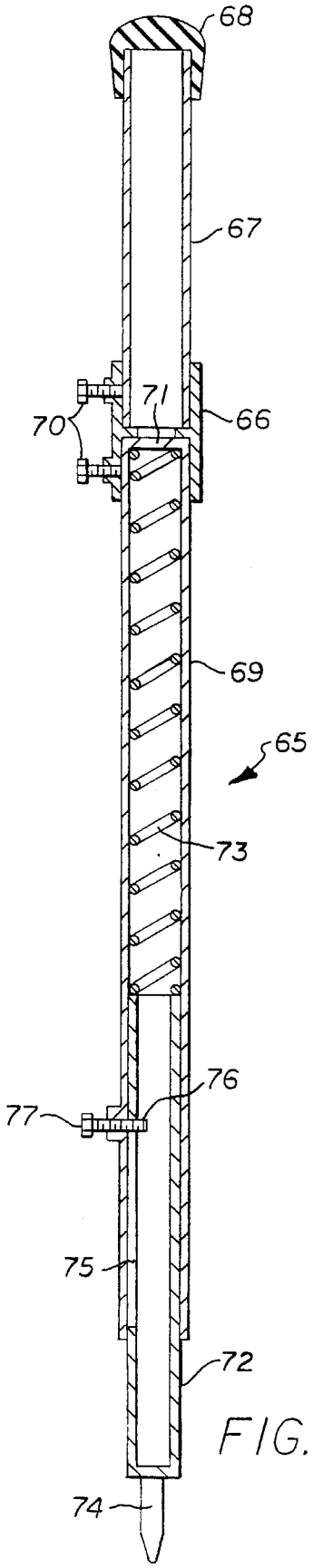
FIG. 3 is a longitudinal cross section through a brick support strut component of the arch support apparatus.

A series of tubular telescopic spring-loaded longitudinally adjustable "pogo sticks" or brick support struts 65 are used with the brick support hub 54. Referring additionally to FIG. 3, each brick support strut 65 has a tubular collar 66 with the bottom end of an upper tubular member 67 received in its top end and a rounded resilient end cap 68 is secured on the top end of the upper tubular member. The top end of an intermediate tubular member 69 is received in the bottom end of the collar 66. Lock screws 70 installed through the side wall of the collar 66 near its top and bottom ends secure the upper and intermediate tubular members 67 and 69 to the collar. The top end of the intermediate tubular member 69 is enclosed by a wall 71. The collar 66 allows interchangeable upper and intermediate tubular members 67 and 69 of various lengths to be assembled to adjust the length of the brick support struts 65 to fit the particular job requirements.

The upper portion of a lower tubular member 72 is slidably received in the lower end of the intermediate tubular member 69. A compression spring 73 is disposed inside the intermediate tubular member 69 with one end engaged on the wall 71 and its opposite end engaged on the top end of the lower tubular member 72 to normally urge them apart. The bottom end of the lower tubular member 72 is enclosed and a short pin 74 extends downwardly from the enclosed bottom end. A longitudinal slot 75 extends through the side wall of the lower tubular member 72 intermediate its top and bottom ends. The shank 76 of a lock screw 77 installed through the side wall of the intermediate tubular member 69 near its lower end is received in the slot 75 to prevent complete removal of the lower tubular member 72, while allowing axial travel relative to the intermediate tubular member 69. The pin end 74 of the brick support struts 65 are received on the flat members 58 of the brick support hub 54 and the brick support struts extend generally radially outward from the brick support hub as described hereinafter.

OPERATION

Having described the major components of the preferred arch support system, the following is a description of its operation in installing a brick lining on a curved surface, utilizing, as an example, a long tunnel having an arcuate ceiling hereinafter referred to as the arch.

Figure 4:
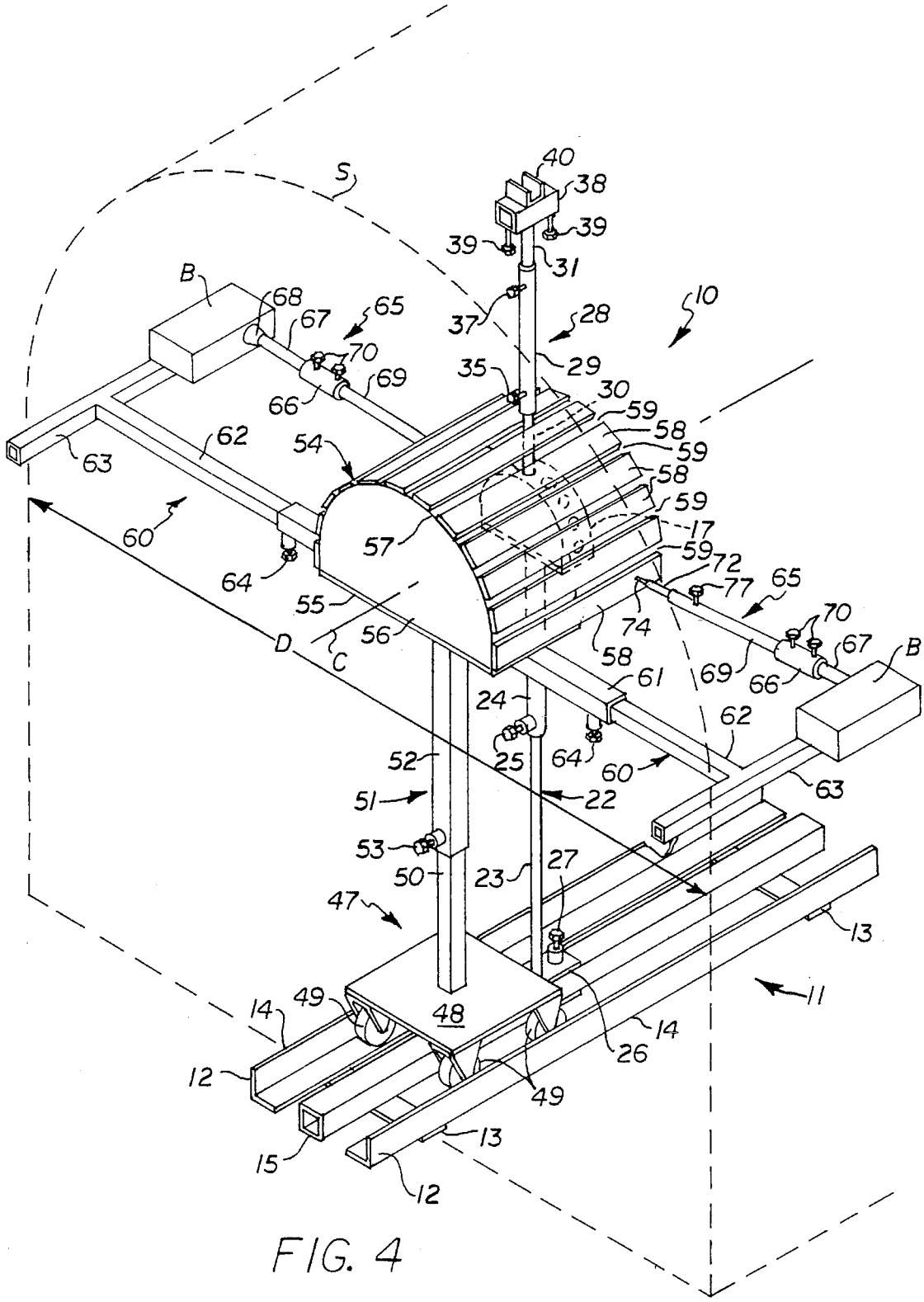
FIG. 4 is an isometric view of the arch support apparatus showing the beginning operation in installing a brick lining on a curved surface.
Figure 5:
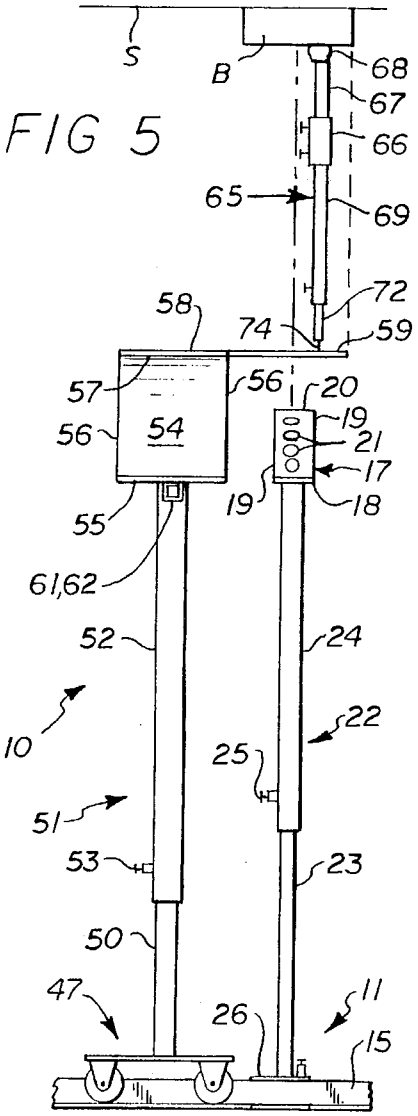
FIG. 5 is a side elevation showing the carriage moved adjacent to the rib support hub such that the outwardly extended portion of the flat members extend beyond the width of the rib support hub and are aligned in the same vertical plane as the outer end of the first ring of bricks to be laid.

Referring to FIGS. 4 and 5, measurements are taken of the curved surface S to be lined to determine overall dimensions of the arch and the span or diameter D of the arch in a horizontal plane, and the center C of the horizontal diameter is calculated. The track assembly 11 is placed on the floor of the tunnel with its center longitudinal axis along a line corresponding to the center C of the horizontal diameter D. If the floor of the tunnel is not flat or level, or if the distance between the top of the arch and the floor is excessive, a suitable scaffold may be erected to create a flat level surface for the track.

The C-shaped clamp 26 at the bottom end of the telescopic vertical support leg 22 of the rib support hub 17 is clamped on the central length of square tubing 15 of the track assembly 11 and the length of the vertical support leg 22 is adjusted to align the rib support hub 17 at the center C of the horizontal diameter of the arch and thereafter locked at the proper length by the lock screw 25. The rib support hub 17 is positioned such that the holes 21 in its arcuate wall 58 will be aligned with the center of the first ring of bricks to be installed. A rib support strut 28 is placed in the top center hole 21 of the rib support hub 17 to extend vertically between the rib support hub and the curved surface S and allowed to extend axially under the force of its compression spring to maintain the hub in the proper position.

The carriage 47 is placed in the track assembly 11, and the length of the vertical support leg 51 is adjusted to place the brick support hub 54 at the center C of the horizontal diameter of the arch and thereafter locked at the proper length by the lock screw 53. As shown somewhat schematically in FIG. 5, the carriage 47 is moved adjacent to the rib support hub 17 such that the outwardly extended portion of the flat members 58 extend beyond the width of the rib support hub. The outer ends of the flat members 58 are aligned to be in the same vertical plane as the outer end of the first ring of bricks to be laid.

The inner members 62 of the telescoping lateral span arms 60 are extended laterally outward from the ends of the center member 61 at the bottom of the brick support hub 54 to engage the tubing members 63 at their outer ends on opposite sides of the tunnel just below the horizontal diameter D of the arch and thereafter locked at the proper lateral extension by the lock screws 64 to maintain the brick support hub 54 centered. When properly positioned, the outer ends of the flat members 58 are aligned in the same vertical plane as the outer end of the first ring of bricks to be laid, and the slots 59 between the flat members 58 are aligned with the radial axis of the holes 21 in the wall of the rib support hub 17.

Figure 6:
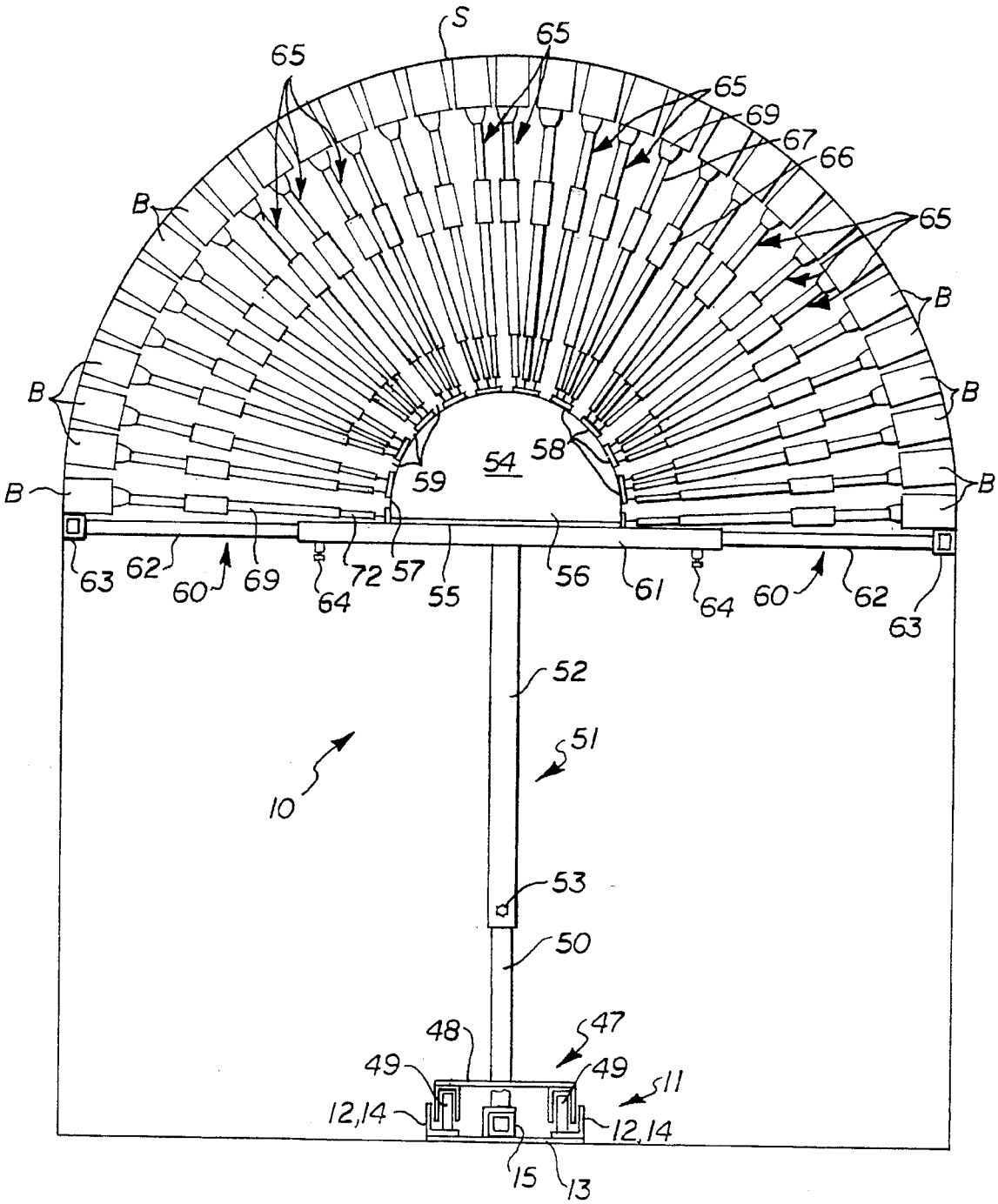
FIG. 6 is an elevation view showing a ring of bricks pressed against the curved surface by the brick support struts.

Referring again to FIG. 4 and 5 and to FIG. 6, starting on the 180° opposite sides of the tunnel at the horizontal diameter, each brick B is "hand buttered" (applying mortar) and placed against the curved surface S of the arch. As each brick is placed on the curved surface S, the pin end of a brick support strut 65 is placed on a flat surface 58 of the brick support hub 54 and compressed radially downward against the spring force of its inner compression spring and then released to engage the resilient end cap 68 at the outer end of the brick support strut 65 on the brick just placed such that the spring force presses the brick against the curved surface S. The end cap 68 of the brick support strut 65 is placed near one end of the brick (approximately the inward ⅓ of the brick length).

As shown in FIG. 6, this step is repeated sequentially working upward from the opposite sides of the arch until a complete arcuate "ring" of brick is completed. Each brick is secured with an individual brick support strut 65. The vertical rib support strut 28 which was used initially to maintain the position of the rib support hub 17 may be used to support the top center brick, or removed and replaced with a brick support strut 65 when installing the top center brick.

Figure 7:
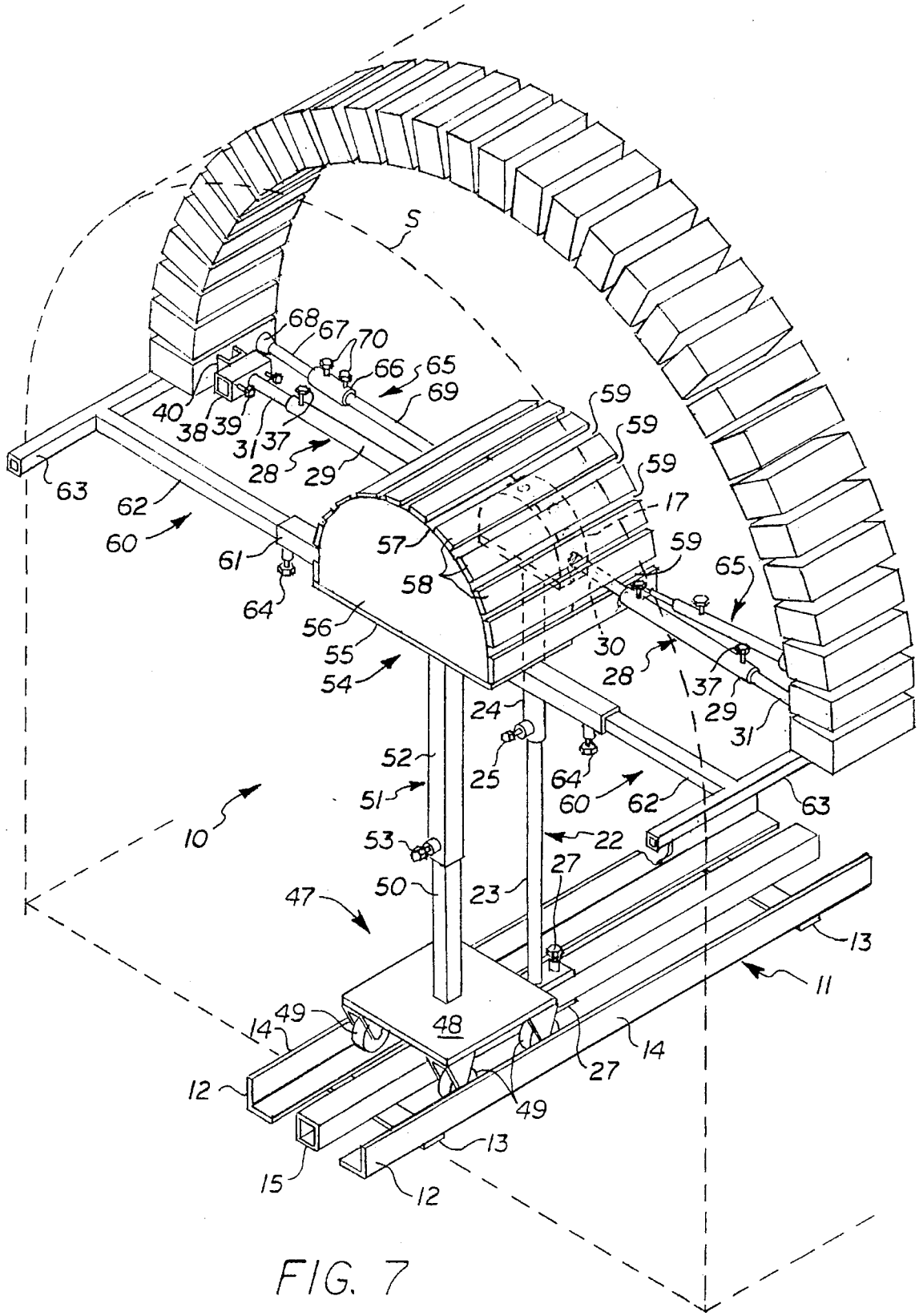
FIG. 7 is an isometric view showing the beginning operation in placing the rib support struts on the previously installed ring of bricks.
Figure 8:
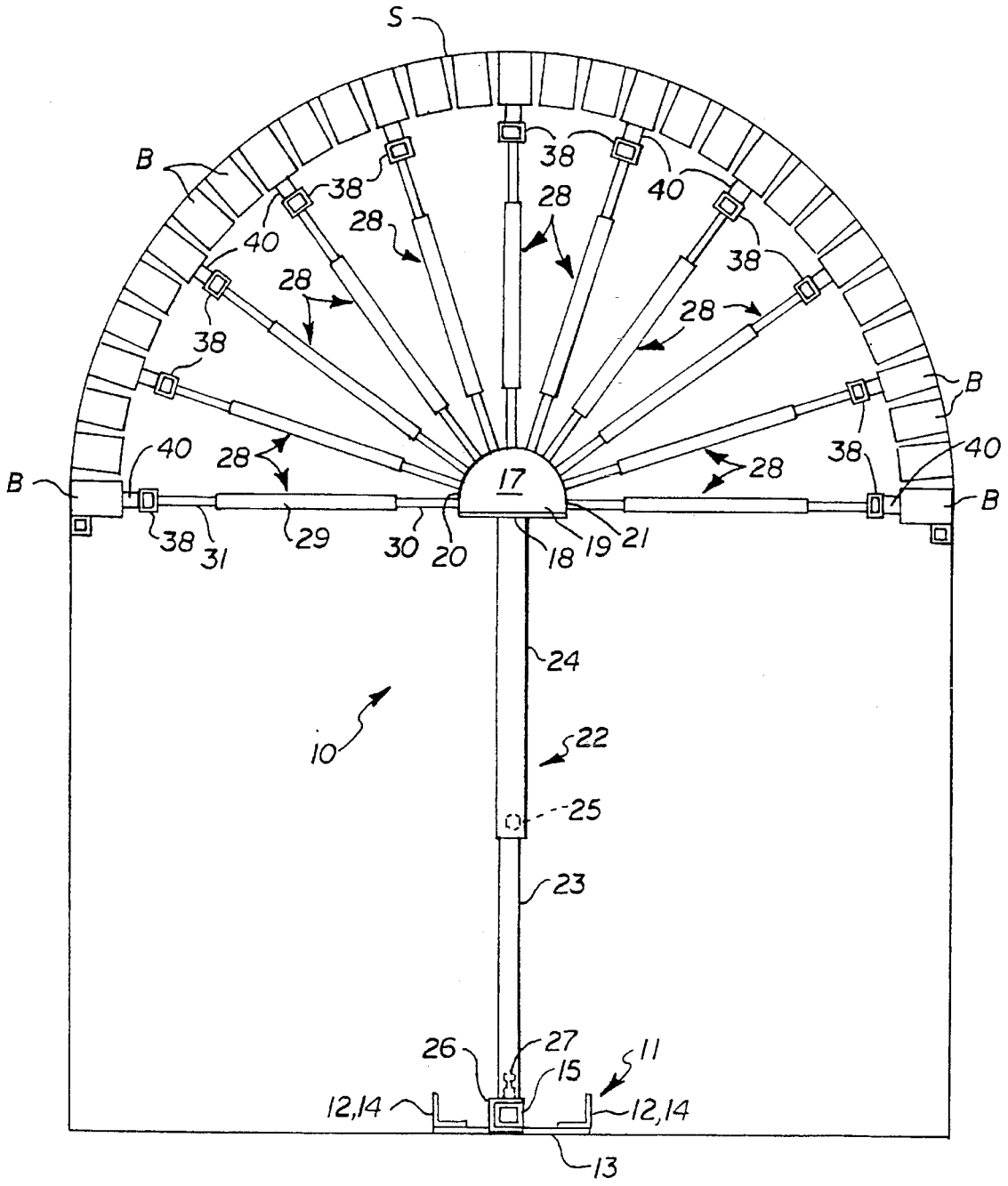
FIG. 8 is an elevation view showing the rib support struts positioned against certain circumferentially spaced bricks of the previously installed ring of bricks.

Referring now to FIGS. 7 and 8, after the brick support struts 65 have been installed, the rib support struts 28 are installed, starting from opposite sides of the arch, by placing the pin end of the rib support struts 28 into the holes 21 in the arcuate top wall 20 of the rib support hub 17 and compressing them radially downward against the spring force of their inner compression spring and then releasing them to engage the channel 40 at the top of each short length of tubing 38 on the approximate center of certain circumferentially spaced ones of the bricks which are supported by the brick support struts 65. The rib support struts 28 extend radially outward from the rib support hub 17 through the slots 59 between adjacent flat members 58 of the brick support hub 54. If the number and spacing of the brick support struts 65 make it difficult to install the rib support struts 28, the interferring brick support struts may be shifted or removed and re-installed as each rib support strut 28 is installed.

The circumferential spacing of the holes 21 in the arcuate top wall 20 of the rib support hub 17 correspond in direct relation to predetermined chord points (for example 14" or 16") on the semicircular ring of bricks installed on the curved surface of the arch. Thus, a channel 40 at the outer end of each rib support strut 28 will engage the center of every third or fourth brick along the circumference of the first ring of bricks.

Figure 9:
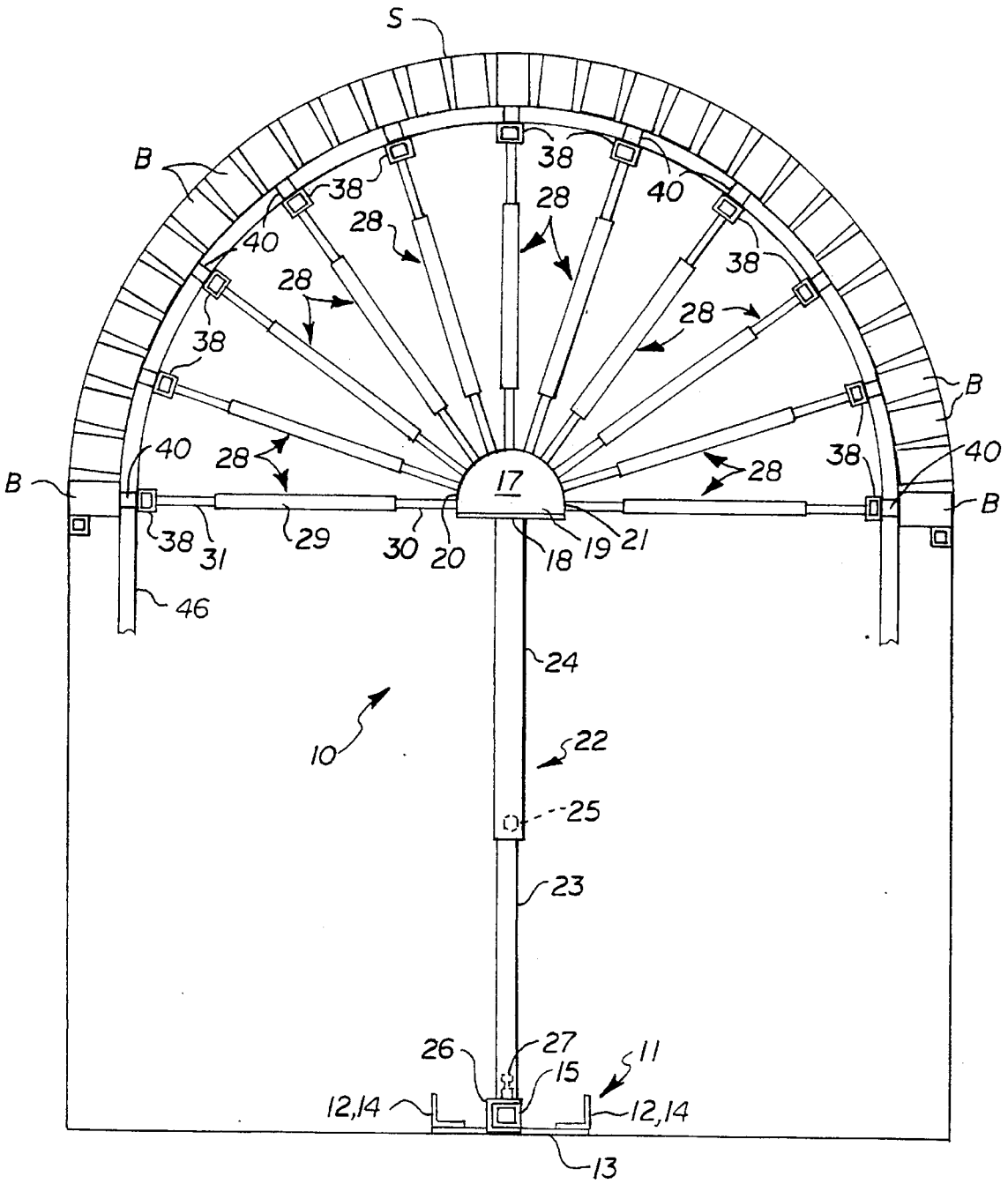
FIG. 9 is an elevation view showing an elongate resilient rib installed and biased against the previously installed ring of bricks by the rib support struts.

As shown in FIG. 9, the elongate resilient rib member 46 is then installed in the channels 40 at the outer ends of the rib support struts 28. This is accomplished by starting at one side of the arch and compressing each rib support strut radially downward against the spring force of its inner compression spring, inserting a segment of the rib 46 into the channel 40 and then releasing the strut 28 to spring bias the rib 46 against the brick. After the rib 46 has been installed, it is spring biased radially outwardly by the spring force of the rib support struts 28 at the 14" or 16" circumferential chord segments. The material of the rib 46 is sufficiently resilient such that when curved along the inner diameter of the brick ring the segments of the rib between the 14" or 16" chord points will also firmly engage the bricks disposed between each third or fourth brick.

Figure 10:
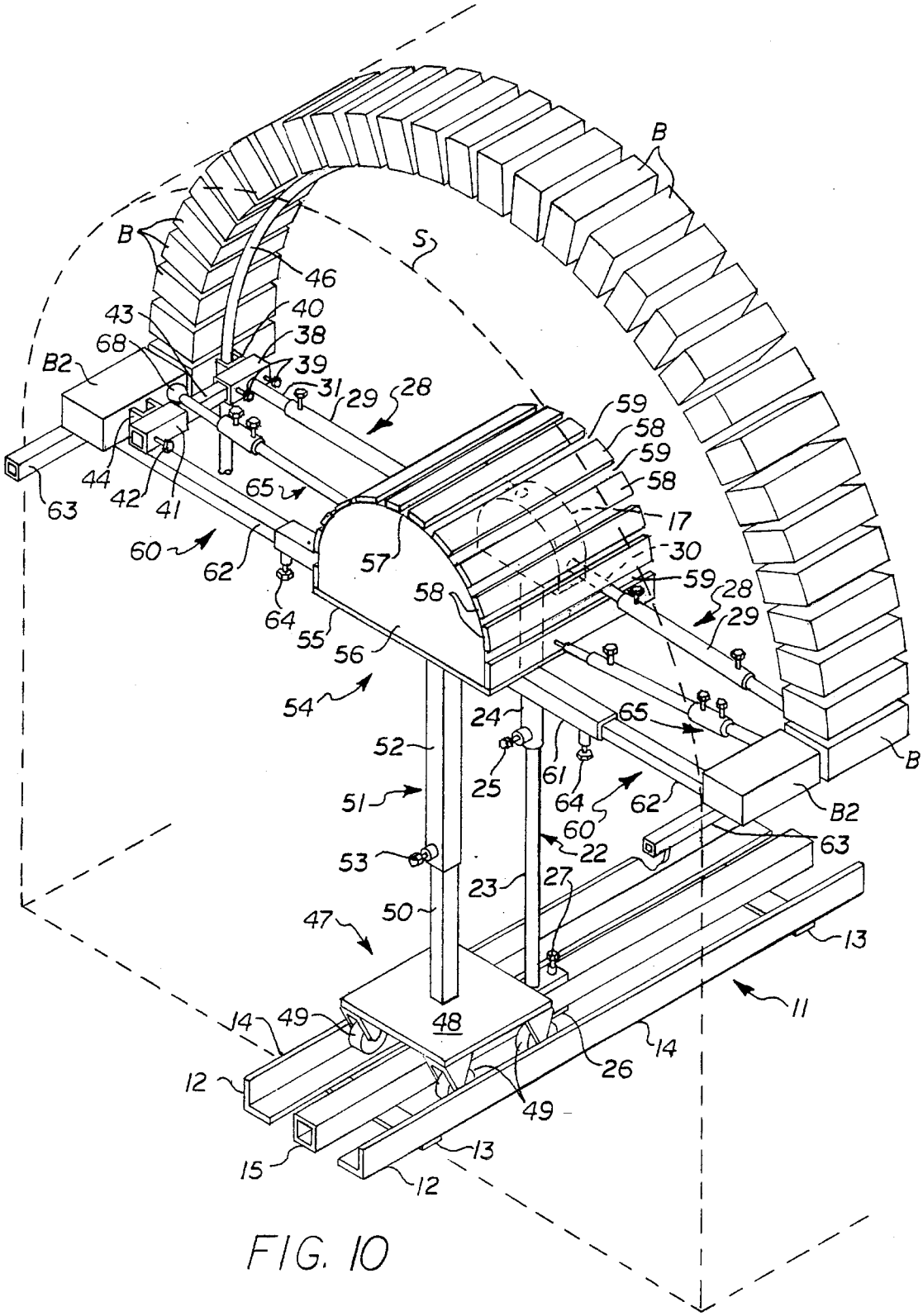
FIG. 10 is an isometric view showing the beginning operation in installing a subsequent ring of bricks adjacent a previously installed ring that is held against the curved surface by a rib and rib support struts, and joining a coupling to the previously installed rib support struts.

As shown in FIG. 10, after the first rib 46 has been installed along the inner diameter of the first ring of bricks, the previously installed brick support struts 65 are removed and a coupling member 41 is slid into each short square tubing 38 at the outer end of each rib support strut, but the lock screws 39 are not tightened. A second ring of bricks is then installed.

Figure 11:
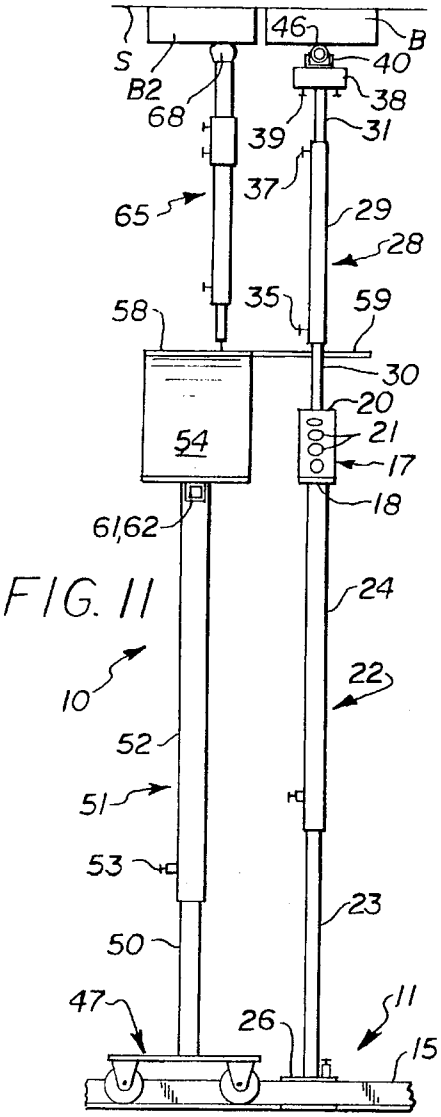
FIG. 11 is a side elevation view showing the installation of a second series of brick support struts after the rib has been installed and biased against the previously installed ring of bricks by the rib support struts.

As shown in FIGS. 10 and 11, starting on the 180° opposite sides of the tunnel at the horizontal diameter, each brick B2 forming the second ring of bricks is "hand buttered" (mortar applied) and placed against the curved surface S of the arch. As each brick B2 is placed on the curved surface S, the pin end of a brick support strut 65 is placed on a flat surface 58 of the arcuate wall 57 of the brick support hub 54 and compressed radially downward against the spring force of its inner compression spring and then released to engage the resilient end cap 68 at the outer end of the brick support strut 65 on the brick just placed such that the spring force presses the brick against the curved surface S. As described previously, the end cap 68 of the brick support strut is placed near the inward ⅓ of the brick length. This step is repeated sequentially working upward from the opposite sides of the arch until the second arcuate "ring" of brick is completed. Each brick B2 of the second ring of bricks is secured with an individual brick support strut 65.

After the brick support struts 65 have been installed on the second ring of bricks, the coupling members 41 are positioned such that the channel 44 of each coupling member 41 is positioned on the approximate center of the brick adjacent the previously installed rib support strut and then the lock screws 39 are tightened (FIG. 10).

Figure 12:
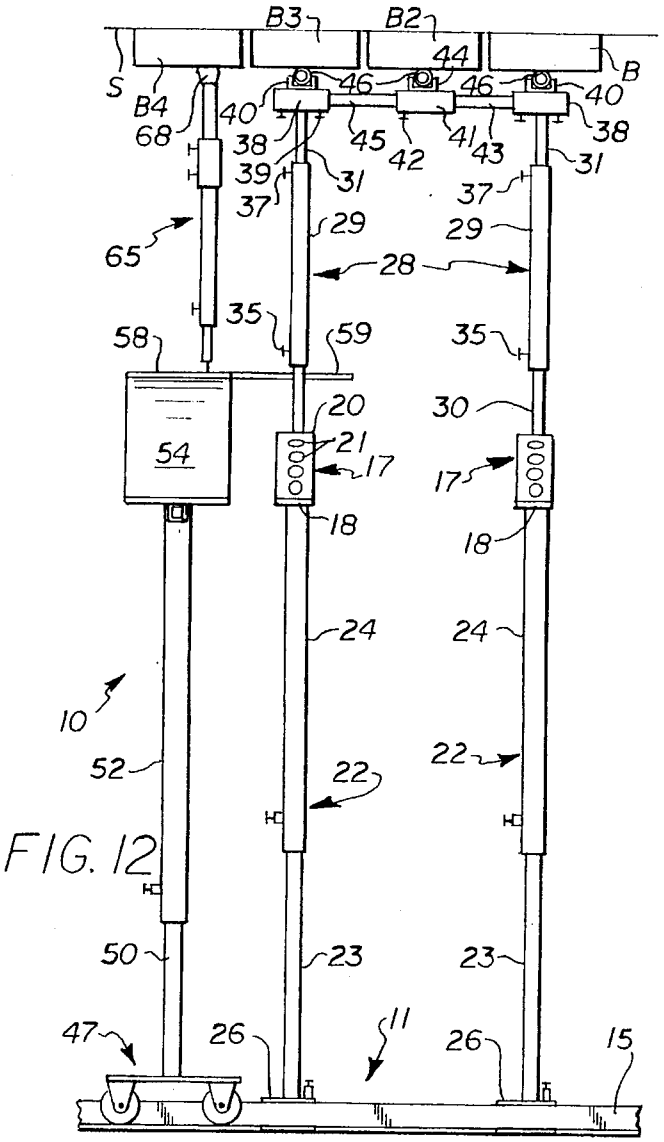
FIG. 12 is a side elevation view showing the installation of a third and fourth ring of bricks adjacent the first and second rings of bricks.

As shown in FIG. 12, after the coupling members 41 have been secured, a second rib 46 is installed in the channels 44 of the coupling members 41. This is accomplished by starting at one side of the arch and compressing each previously installed rib support strut 28 radially downward against the spring force of its inner compression spring which carries the coupling member 41 with it, inserting a segment of the rib 46 into the channel 44 of the coupling 41 and then releasing the strut 28 to spring bias the rib against the brick. This will not affect the previously installed rib because it is still spring biased outwardly by the spring force of the other rib support struts 28 adjacent the one being compressed which are still spring biased outwardly and the previously installed rib remains firmly engaged on the previously installed ring of bricks.

After the second rib has been installed along the inner diameter of the second ring of bricks B2, the previously installed brick support struts are removed, and the carriage is moved along the track 11 away from the previously installed rib support hub 17. A second rib support hub 17 is installed on the track 11, and positioned such that the holes 21 in its outer wall 20 are aligned at the center of the third ring of bricks B3 to be installed, as described previously. A tubular spacer extension 45 is installed in the end of the previously installed coupling member 41, but the lock screws 42 are not tightened.

The carriage 47 is then moved to a position adjacent the rib support hub 17 such that the outwardly extended portion of the flat members 58 extend beyond the width of the rib support hub and the outer ends of the flat members 58 are aligned to be in the same vertical plane as the outer end of the third ring of bricks B3 to be laid, and the telescoping lateral span arms 60 are extended laterally outward to engage the tubing members 63 at their outer ends on opposite sides of the tunnel and locked to maintain the brick support hub 54 centered. When properly positioned, the outer ends of the flat members 58 are aligned in the same vertical plane as the outer end of the third ring of bricks B3 to be laid, and the slots 59 between the flat members 58 are aligned with the radial axis of the holes 21 in the rib support hub 17, and the steps of hand buttering and placing the bricks, and securing each one with a brick support strut is repeated, working upward from the opposite sides of the arch until the third arcuate ring of bricks is completed, as previously described with the first ring of bricks.

After the brick support struts have been installed on the third ring of bricks, and starting from opposite sides of the arch, a second series of rib support struts 28 are installed, as described previously, by placing their pin ends into the holes 21 in the second rib support hub 17 and compressing them radially downward and then releasing them to engage the channel 40 at their outer ends on the approximate center of certain circumferentially spaced ones of the third ring of bricks B3. As the rib support struts are being compressed or released, the spacer extensions 45 extending outwardly from the previously installed couplings 41 are slid into the short lengths of tubing 38 at the outer ends of the rib support struts 28 and the lock screws 39 and 42 are tightened when the channel 40 is centered on the brick B3.

After the spacer extensions 45 have been secured, a third rib 46 is installed in the channels 40 at the outer ends of the second series of rib support struts 28 by starting at one side of the arch and compressing each second series of rib support struts 28 radially downward against the spring force of its inner compression spring which carries the extension and adjacent coupling with it, inserting a segment of the third rib 46 into the channel 44 of the coupling 41 and then releasing the strut 28 to spring bias the rib against the brick. This will not affect the previously installed ribs because they are still spring biased outwardly by the spring force of the other rib support struts 28 of the second series and the couplings and rib support struts adjacent the one being compressed.

After the third ribs have been installed, another coupling 41 is slid into each short square tubing 38 at the outer end of each rib support strut of the second series, but the lock screws are not tightened. A fourth ring of bricks B4 is then installed.

Starting on the 180° opposite sides of the tunnel at the horizontal diameter, each brick forming the fourth ring is "hand buttered" (mortar applied) and placed against the curved surface of the arch. As each brick B4 is placed on the curved surface S, the pin end of a brick support strut 65 is placed on a flat surface 58 of the brick support hub 54 and compressed radially downward against the spring force of its inner compression spring and then released to engage the resilient end cap 68 at the outer end of the brick support strut on the brick just placed such that the spring force presses the brick against the curved surface, as described previously. This step is repeated sequentially working upward from the opposite sides of the arch until the fourth arcuate "ring" of brick is completed and each brick B4 of the fourth ring of bricks is secured with an individual brick support strut.

After the brick support struts have been installed on the fourth ring of bricks, another series of coupling members are positioned such that the channel of each coupling is positioned on the approximate center of the brick adjacent the previously installed rib support strut and then their lock screws are tightened. After the coupling members have been secured, a fourth rib is installed in the channels of the couplings in the manner described previously.

After the fourth rib has been installed along the inner diameter of the second ring of bricks, the previously installed brick support struts are removed, and the carriage is again moved along the track away from the previously installed rib support hub, and the next rib support hub is installed on the track, and positioned such that the holes in its outer wall are aligned at the center of the next ring of bricks to be installed, and the steps of installing the spacer extensions, brick support struts, rib support struts, couplings, and ribs, are repeated If the mortar holding the first ring of bricks has set or cured, the first installed rib support struts, rib, couplings, extensions, and rib support hub may be removed and reused. These steps are repeated moving longitudinally along the length of the tunnel and installing a rib support hub at the center of each third ring of bricks until the final ring of bricks is installed.

Although the above procedure describes a series of rib support struts being installed on each third ring of bricks, it should be understood that several extensions and couplings may be installed between the series of longitudinally spaced rib support struts. Preferably, the number of components are correlated to the setting or curing time whereby the first and subsequently installed components can be removed and reused over and over sequentially as the work progresses continuously to reduce the number of components required and to eliminate having to wait for the mortar to set.

While this invention has been described fully and completely with special emphasis upon a preferred embodiment, it should be understood that within the scope of the appended claims the invention may be practiced otherwise than as specifically described herein.

I claim:

1. Arch support apparatus for supporting brickwork against a curved surface during masonry construction comprising:

a first hub member adapted to be positioned at the approximate center of a curved surface to be lined with bricks;

a second hub member adapted to be positioned adjacent said first hub at the approximate center said curved surface;

a plurality of tubular telescopic spring-loaded brick support struts each having an inner end and an outer end normally urged away from each other, each inner end adapted to be engaged on said second hub member to extend generally radially outward therefrom, and said outer end adapted to engage the surface of a previously mortared brick to press the mortared brick against the curved surface to be lined;

a number of said previously mortared bricks being sequentially placed against the curved surface and spring biased by said plurality of brick support struts to form a ring of adjacent circumferentially spaced bricks each biased against the curved surface by a said brick support strut;

a plurality of tubular telescopic spring-loaded rib support struts each having an inner end and an outer end normally urged away from each other, each said rib support strut inner end adapted to be engaged on said first hub member to extend radially outward therefrom, and said outer end adapted to engage the approximate center of the surface of certain ones of said adjacent circumferentially spaced bricks and configured to receive and engage a portion of an elongate resilient rib member; and at least one elongate resilient rib member of sufficient length and resiliency to circumscribe the interior surface of said ring of adjacent circumferentially spaced bricks and exert a radial outward force thereon.

2. The apparatus according to claim 1 further comprising a plurality of coupling members each releasably connected with a said rib support strut and positioned in adjacent spaced relation with respect to said outer end of said rib support strut, each said coupling member configured to receive and engage a portion of a said elongate resilient rib member.

3. The apparatus according to claim 2 further comprising a plurality of extension members each connected to a said coupling member and a said rib support strut to extend therebetween.

4. The apparatus according to claim 2 in which each said coupling member is formed of a length of square tubing and having a length of square tubing extending outwardly from one end thereof, and a generally U-shaped channel member secured to the side wall of said coupling member to receive said rib member.

5. The apparatus according to claim 1 further comprising elongate track means adapted to be supported on a flat surface beneath said curved surface and having a central longitudinal axis positioned beneath the approximate center of said curved surface, and first vertical support means movably mounted at a lower end on said track means for longitudinal movement thereon and connected at an upper end to said first hub member, and vertically adjustable for positioning said first hub member at the approximate center of said curved surface.

6. The apparatus according to claim 5 further comprising second vertical support means movably mounted at a lower end on said track means for longitudinal movement thereon and connected at an upper end to said second hub member, and vertically adjustable for positioning said second hub member at the approximate center of said curved surface.

7. The apparatus according to claim 1 in which said first hub member has a curved surface spaced radially inward from said curved surface to be lined when said first hub is position at the approximate center thereof to receive and support said inner end of said rib support struts.

8. The apparatus according to claim 7 in which said curved surface of said first hub member has a plurality of adjacent circumferentially spaced holes extending a distance radially inward therefrom with the spacing correlated to predetermined chord points on said ring of adjacent circumferentially spaced bricks.

9. The apparatus according to claim 1 in which said second hub member has a generally curved surface spaced radially inward from said curved surface to be lined when said second hub is position at the approximate center thereof to receive and support said inner end of said brick support struts.

10. The apparatus according to claim 9 in which said generally curved surface of said second hub member has a plurality of adjacent circumferentially spaced flat surfaces thereon defining slots between said flat surface with the spacing of said slots correlated to predetermined chord points on said ring of adjacent circumferentially spaced bricks.

11. The apparatus according to claim 1 further comprising lateral support means connected with said second hub member adapted to extend laterally outward from opposite sides thereof and engage opposite sides of said curved surface to be lined to maintain said second hub at the approximate center of said curved surface.

12. The apparatus according to claim 1 in which each said brick support strut comprises a tubular collar having an open top and bottom end, an upper tubular member having a bottom end received in the top end of said collar, a resilient element at the top end of said upper tubular member, an intermediate tubular member having an enclosed top end received in the bottom end of said collar and an open bottom end, a lower tubular member having a top end and a bottom end and a longitudinal slot in its side wall intermediate said top and bottom ends and the upper portion of said lower member slidably received in the bottom end of said intermediate tubular member, a compression spring disposed inside said intermediate tubular member with one end engaged on said enclosed top end of said intermediate tubular member and its opposite end engaged on said top end of said lower tubular member to normally urge them apart, and a lock screw installed through the side wall of said intermediate tubular member with its shank received in said slot of said lower tubular member to prevent complete removal of said lower tubular member while allowing axial travel relative to said intermediate tubular member.

13. The apparatus according to claim 12 including lock screws installed through the side wall of said collar to removably fasten said upper tubular member and said intermediate tubular member to said collar and allow combinations of different lengths of said upper tubular members and said intermediate tubular members to be fastened to said collar to fit particular installation requirements.

14. The apparatus according to claim 12 including a short pin depending from the bottom end of said lower tubular member.

15. The apparatus according to claim 1 in which each said rib support strut comprises an intermediate tubular member having an open top and bottom end, an upper tubular member having a bottom end received in the top end of said intermediate tubular member and a top end, a lock screw installed through the side wall of said intermediate tubular member to removably fasten said upper tubular member to said intermediate tubular member and allow combinations of different lengths of said upper tubular members and said intermediate tubular members to be fastened together to fit particular installation requirements, a lower tubular member having a top end and a bottom end and a longitudinal slot in its side wall intermediate said top and bottom ends and the upper portion of said lower member slidably received in the bottom end of said intermediate tubular member, a compression spring disposed inside said intermediate tubular member with one end engaged on the bottom end of said upper tubular member and its opposite end engaged on said top end of said lower tubular member to normally urge them apart, a lock screw installed through the side wall of said intermediate tubular member with its shank received in said slot of said lower tubular member to prevent complete removal of said lower tubular member while allowing axial travel relative to said intermediate tubular member.

16. The apparatus according to claim 15 including a short pin depending from the bottom end of said lower tubular member of said rib support strut.

17. The apparatus according to claim 15 further comprising a short length of square tubing secured at the top end of end of said upper tubular member of said rib support strut to extend transverse thereto, a U-shaped channel member secured to the exterior of said short length of square tubing to receive said rib member, and a pair of lock screws extending through the side wall of said short length of square tubing.

18. Arch support apparatus for supporting brickwork against a curved surface during masonry construction comprising:

a hub member adapted to be positioned at the approximate center of a curved surface to be lined with bricks; and a plurality of manually compressible tubular telescopic spring-loaded brick support struts each containing a compression spring and having an inner end and an outer end normally urged away from each other in an extended condition by said spring, each inner end adapted to be removably supported on an exterior surface of said hub member to extend generally radially outward therefrom, and said outer end adapted to removably engage the surface of a recently mortared brick in the extended condition to press the mortared brick against the curved surface to be lined.

19. Arch support apparatus for supporting a ring of adjacent previously mortared bricks against a curved surface during masonry construction comprising:

a hub member adapted to be positioned at the approximate center of a curved surface to be lined with bricks;

a plurality of tubular telescopic spring-loaded rib support struts each having an inner end and an outer end normally urged away from each other, each said rib support strut inner end adapted to be engaged on said hub member to extend radially outward therefrom, and said outer end adapted to engage the surface of circumferentially spaced ones of said ring of adjacent previously mortared bricks and configured to receive and engage a portion of an elongate resilient rib member; and an elongate resilient rib member of sufficient length and resiliency to circumscribe the interior surface of said ring of adjacent previously mortared bricks and exert a radial outward force thereon;

said rib member received on said outer end of each of said plurality of said rib support struts at circumferentially spaced locations; and said ring of adjacent previously mortared bricks being pressed against said curved surface by the resiliency of said rib member and the spring force of said plurality of said rib support struts.

20. A method for supporting brickwork against a curved surface during masonry construction comprising the steps of:

positioning a first hub member at the approximate center of a curved surface to be lined with bricks;

positioning a second hub member at the approximate center of said curved surface adjacent said first hub;

sequentially placing each of a plurality of tubular telescopic spring-loaded brick support struts to extend radially outward from said second hub member and engage a recently mortared brick placed against said curved surface to be lined to form a ring of adjacent circumferentially spaced bricks each pressed against the curved surface by a said brick support strut;

sequentially placing each of a plurality of tubular telescopic spring-loaded rib support struts to extend radially outward between said first hub member and the approximate center of certain ones of said ring of adjacent circumferentially spaced bricks; and sequentially compressing each of said rib support struts radially inward and installing a portion of an elongate resilient rib member between an outer end of each said rib support strut and said certain ones of said bricks, and then releasing each said rib support strut outer end to engage said rib member at circumferentially spaced locations such that said rib member circumscribes the interior surface of said ring of adjacent circumferentially spaced bricks and exerts a radial outward force thereon; whereby said ring of bricks is pressed against said curved surface by the resiliency of said rib member and the spring force of said plurality of said rib support struts said plurality of brick support struts may be removed.

21. The method according to claim 20 including the further steps of:

after installing said ring of bricks and said rib member;

removing said previously installed plurality of said brick support struts;

sequentially placing each of a plurality of said brick support struts to extend radially outward between said second hub member and a recently mortared brick placed against said curved surface adjacent said ring of bricks previously installed to form a second ring of adjacent circumferentially spaced bricks each pressed against the curved surface by a said brick support strut;

connecting a coupling member to each said rib support strut to extend outwardly therefrom such that said coupling member is positioned at the approximate center of certain ones of said second ring of adjacent circumferentially spaced bricks; and sequentially compressing each of said plurality of rib support struts previously installed and said coupling connected thereto radially inward and installing a portion of a second elongate resilient rib member between an outer end of each said coupling member and said certain ones of said second ring of bricks, and then releasing each said rib support strut to engage said second rib member at circumferentially spaced locations such that said second rib member circumscribes the interior surface of said second ring of bricks and exerts a radial outward force thereon; whereby said second ring of bricks is pressed against said curved surface by the resiliency of said second rib member and the spring force of said plurality of said rib support struts and said coupling members connected thereto and said plurality of brick support struts may be removed.

22. The method according to claim 21 including the further steps of:

after installing said second ring of bricks and said second rib member;

removing said previously installed plurality of said brick support struts and moving said second hub member away from said first hub;

positioning a third hub member at the approximate center of said curved surface;

repositioning said second hub member adjacent said third hub member at the approximate center of said curved surface to lie in a plane with one end of said second ring of bricks previously installed;

sequentially placing each of a plurality of said brick support struts to extend radially outward between said second hub member and a recently mortared brick placed against said curved surface adjacent said second ring of bricks to form a third ring of adjacent circumferentially spaced bricks each pressed against the curved surface by a said brick support strut;

sequentially placing each of a second plurality of said rib support struts to extend radially outward between said third hub member and the approximate center of certain ones of said third ring of adjacent circumferentially spaced bricks;

connecting an extension member to each said coupling member previously installed and to each of said second plurality of rib support struts to extend therebetween; and sequentially compressing each of said second plurality of rib support struts and said extension and coupling connected thereto radially inward and installing a portion of a third elongate resilient rib member between an outer end of each of said second plurality of rib support struts and said certain ones of said third ring of bricks, and then releasing each to engage said third rib member at circumferentially spaced locations such that said third rib member circumscribes the interior surface of said third ring of bricks and exerts a radial outward force thereon; whereby said third ring of bricks is pressed against said curved surface by the resiliency of said third rib member and the spring force of said second plurality of said rib support struts and said extension and coupling connected thereto and said plurality of said brick support struts may be removed.

* * * * *